US011713181B2

(12) United States Patent
Ashcroft

(10) Patent No.: US 11,713,181 B2
(45) Date of Patent: Aug. 1, 2023

(54) APPARATUS FOR HOLDING A FOOD PRODUCT, AND ALLOWING A USER TO CONSUME THE FOOD PRODUCT WITHOUT CONTACT

(71) Applicant: Barbara Ashcroft, Germantown, TN (US)

(72) Inventor: Barbara Ashcroft, Germantown, TN (US)

( * ) Notice: Subject to any disclaimer, the term of this patent is extended or adjusted under 35 U.S.C. 154(b) by 0 days.

(21) Appl. No.: 17/578,349

(22) Filed: Jan. 18, 2022

(65) Prior Publication Data

US 2022/0227565 A1 Jul. 21, 2022

Related U.S. Application Data

(60) Provisional application No. 63/138,565, filed on Jan. 18, 2021.

(51) Int. Cl.
*B65D 83/00* (2006.01)
*B65D 5/38* (2006.01)

(52) U.S. Cl.
CPC ..... *B65D 83/0005* (2013.01); *B65D 5/38* (2013.01); *B65D 2583/00* (2013.01)

(58) Field of Classification Search
CPC .. B65D 83/0005; B65D 5/38; B65D 5/48002; B65D 2583/00; A45C 11/20
USPC ..... 222/386; 206/509, 557; 220/500, 556, 220/557; 229/125.125, 12, 87.08, 407, 229/900, 938, 125.12
See application file for complete search history.

(56) References Cited

U.S. PATENT DOCUMENTS 3,302,844 A * 2/1967 Henry ..... B65D 5/38 229/125.125
4,221,320 A * 9/1980 Faller ..... B65D 5/38 229/125.05
10,232,976 B2 * 3/2019 Waddington ..... B65D 5/0281
10,683,137 B2 * 6/2020 Hawry ..... B65D 21/086

FOREIGN PATENT DOCUMENTS

WO WO 2015/168045 A1 * 11/2015

* cited by examiner

*Primary Examiner* — Lien M Ngo
(74) *Attorney, Agent, or Firm* — Hulsey P.C.

(57) ABSTRACT

Apparatus for holding a food product and allowing a user to consume the food product without contact including a container. The container presents a base, a front wall, a rear wall, and sidewalls. The apparatus further includes a sleeve. The sleeve includes a top portion, a bottom portion, and sidewalls. The top portion, bottom portion, and sidewalls form an interior. The container stores a food product such as a sandwich and an article such as tissue paper. The sleeve slidably receives the container. A user slides open the container from the sleeve and removes the food product. Subsequently, the user places the food product through the interior with support from the front wall. The user slides the container in the interior from one end to another end of the sleeve while consuming the food product. The apparatus allows the user to consume the food product without contacting the food product.

7 Claims, 13 Drawing Sheets

APPARATUS FOR HOLDING A FOOD PRODUCT, AND ALLOWING A USER TO CONSUME THE FOOD PRODUCT WITHOUT CONTACT

CROSS-REFERENCE TO RELATED APPLICATIONS

The present application claims priority from U.S. Provisional Patent Application Ser. No. 63/138,565, filed on Jan. 18, 2021, which is incorporated herein by its entirety and referenced thereto.

FIELD OF THE INVENTION

The present invention generally relates to an apparatus for holding a food product. More specifically, the present invention relates to an apparatus for holding a food product such as a sandwich, the apparatus that allows a user to consume the food product without contacting the food product.

BACKGROUND OF THE INVENTION

It is known that children and adults alike use containers for storing food products for later consumption. An example of a container includes a lunch box. Examples of food products include, but not limited to, sandwiches, eggs, bakery products, etc. When the time approaches, a user (child or adult) opens the container and picks up the food product with his/her hand for consuming the food product.

Use of the hands for consuming the food product may result in contents of the food product coming in contact with the hands. This requires the user to wash hands during or after consuming the food product. Alternatively, the user may have to use tissue papers or wipes to clean his/her hands. The user may have to use multiple containers for storing the food product, water, and/or tissue paper. The above process may present an unpleasant experience for the user.

Therefore, there is a need for an apparatus for holding a food product such as a sandwich, the apparatus capable of allowing a user to consume the food product without contacting the food product.

BRIEF SUMMARY OF THE INVENTION

It is an object of the present invention to provide an apparatus for holding a food product such as a sandwich that avoids the drawback of known containers.

It is another object of the present invention to provide an apparatus that allows a user to consume food product(s) without contacting the food product and maintain a clean environment.

In order to overcome the limitations here stated, the present invention provides an apparatus for holding a food product and allowing a user to consume the food product without contact. The apparatus includes a container. The container presents a base, a front wall, a rear wall, and sidewalls. In other words, the container indicates a box having a base, front wall, rear wall, and sidewalls with an open top. The container encompasses a partition wall for separating the container into two parts. The apparatus further includes a sleeve. The sleeve includes a top portion, a bottom portion, and sidewalls. The top portion, bottom portion, and sidewalls form an interior.

The container stores a food product such as a sandwich and an article such as tissue paper. The sleeve slidably receives the container. A user slides open the container from the sleeve and removes the food product. In other words, the user slides the container partially away from the sleeve and removes the food product. Subsequently, the user places the food product through the interior with support from the front wall. Here, the food product rests over the front wall of container and is surrounded by the top portion, the bottom portion, and the second sidewalls of the sleeve. The user slides the container in the interior from one end to another end of the sleeve while consuming the food product. The apparatus allows for the user to consume the food product without contacting the food product.

In one example, the front wall of the container and the front end of the sleeve include a concave or curved configuration. Further, the rear wall of the container and the rear end of the sleeve include a flat configuration. In another example, the front wall of the container includes a flat configuration and the front end of the sleeve includes a concave or curved configuration. In such an example, the front wall and the front end present a gap allowing the user to hold and slide the container from the sleeve.

In another example, the front wall of the container and the front end of the sleeve include a flat configuration. In one example, the rear wall of the container includes a cut-section allowing the user to hold and slide the container from the sleeve.

In one advantageous feature of presently disclosed invention, the apparatus allows for storing food product(s) and article(s). When needed, the user removes the food product from the container and places the food product in the sleeve with support from the front wall of the container. The user pushes or slides the container through the sleeve as he/she consumes the food product. This helps the user to hold the food product without directly contacting the food product. Further, this ensures that the contents of the food product (including excess food particles and/or residual items) fall outside of the apparatus thereby ensuring the hands of the user remain clean while consuming the food product.

Features and advantages of the invention hereof will become more apparent in light of the following detailed description of selected embodiments, as illustrated in the accompanying FIGUREs. As will be realized, the invention disclosed is capable of modifications in various respects, all without departing from the scope of the invention. Accordingly, the drawings and the description are to be regarded as illustrative in nature.

BRIEF DESCRIPTION OF THE DRAWINGS

The present invention will now be described in detail with reference to the drawings, which are provided as illustrative examples of the invention as to enable those skilled in the art to practice the invention. It will be noted that throughout the appended drawings, like features are identified by like reference numerals. Notably, the FIGUREs and examples are not meant to limit the scope of the present invention to a single embodiment, but other embodiments are possible by way of interchange of some or all of the described or illustrated elements and, further, wherein.

DETAILED DESCRIPTION OF THE EMBODIMENTS

The detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed apparatus. However, it will be apparent to those skilled in the art that the presently disclosed invention may be practiced without these specific details. In some instances, well-known structures and devices are shown in functional or conceptual diagram form in order to avoid obscuring the concepts of the presently disclosed apparatus.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present disclosure provides a description of an apparatus for holding a food product and allowing a user to consume the food product without contact, it is to be further understood that numerous changes may arise in the details of the embodiments of the apparatus. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

Figure 1:
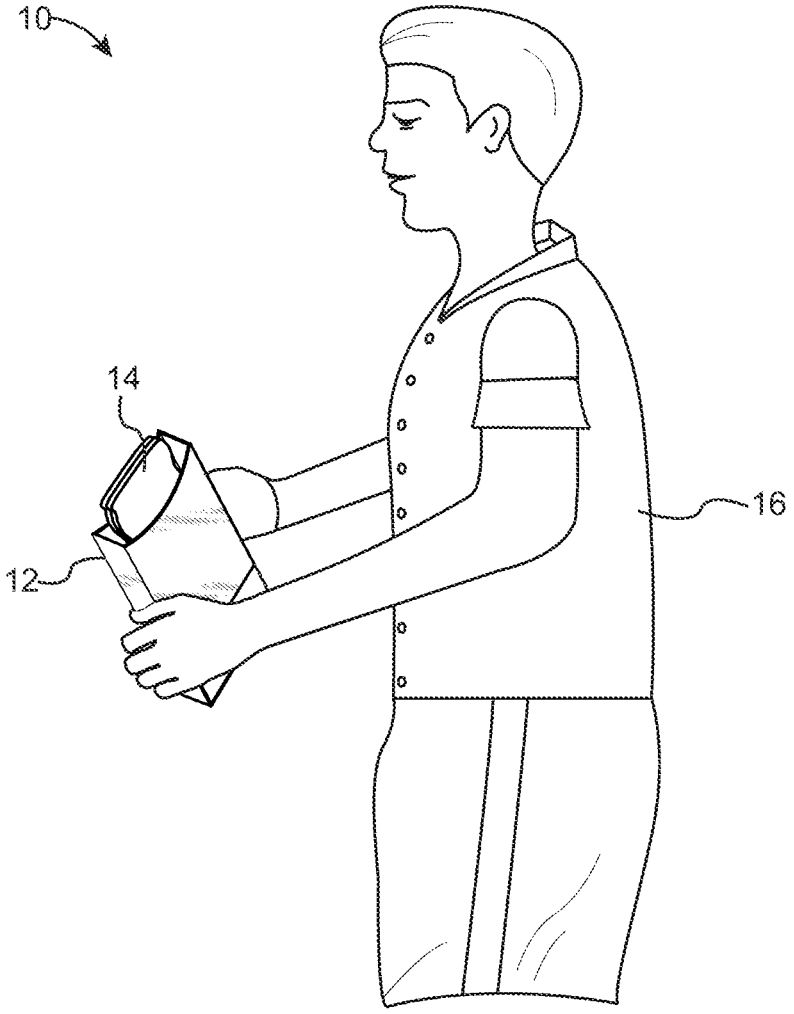
FIG. 1 illustrates an environment of an apparatus for holding a food product, and allowing a user to consume the food product without contact, in accordance with one exemplary embodiment of the present invention.
Figure 2:
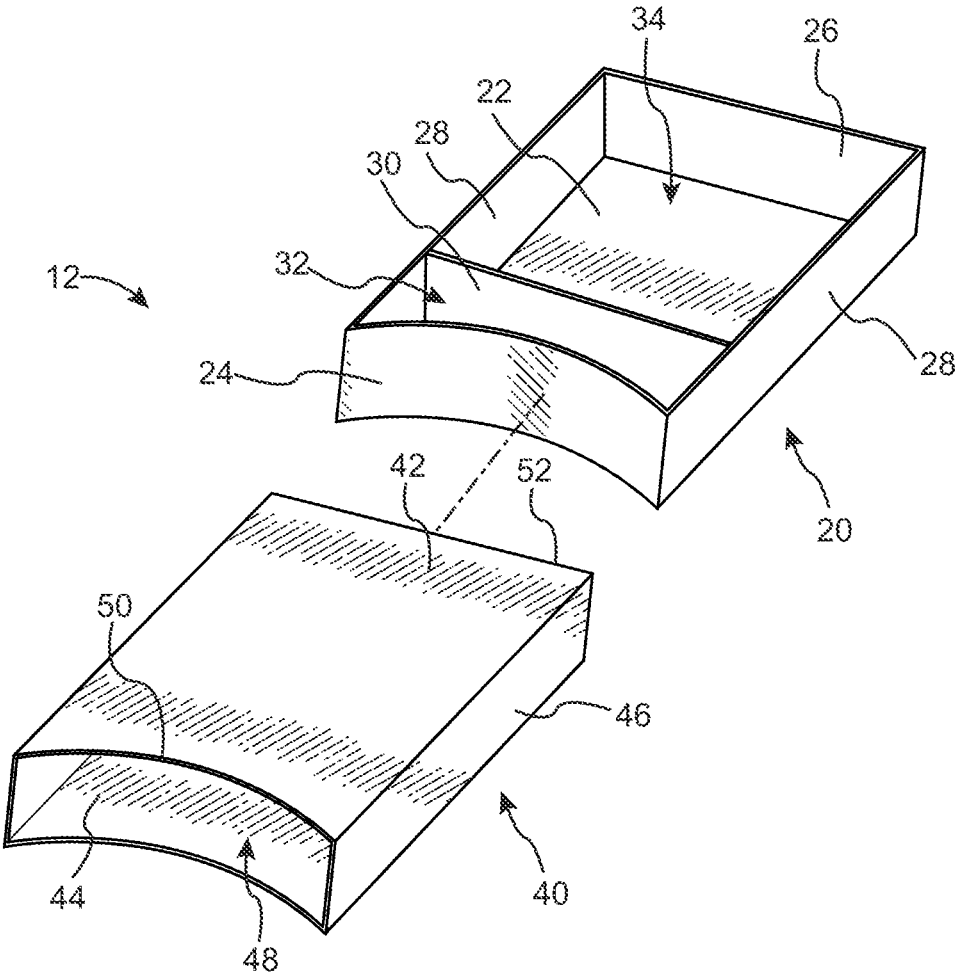
FIGS. 2 and 3 show an exploded view and a perspective view of the apparatus, respectively.

In one embodiment, the present invention discloses an apparatus for holding a food product and allowing a user to consume the food product without contact. FIG. 1 shows environment 10 of apparatus 12 holding food product 14, in accordance with one embodiment of the present invention. A user 16 holds apparatus 12 for consuming food product 14. FIG. 2 shows an exploded view of apparatus 12, in accordance with one embodiment of the present invention. Apparatus 12 includes container 20. Container 20 indicates a box-like structure made of a material such as paper, flute (cardboard), plastic, wooden, metal, or any other suitable material. Container 20 presents base 22, front wall 24, rear wall 26, and sidewalls 28. In the current embodiment, front wall 24 mounts at a front end of container 20 and rear wall 26 mounts at a rear end of container 20. In one example, base 22 comes in a rectangular, square, cylindrical, or any other shape. Front wall 24, rear wall 26, and sidewalls 28 have suitable height and provide depth with base 22. In the current embodiment, front wall 24 has a concave or curved configuration. Rear wall 26 has a flat or straight configuration and is perpendicular to sidewalls 28. In the current embodiment, sidewalls 28 have a length greater than front wall 24 and rear wall 26 thereby providing container 20 in a rectangular configuration.

Container 20 encompasses partition wall 28. Partition wall 30 mounts parallelly to rear wall 26. Partition wall 28 forms first opening 32 together with base 22, front wall 24, and sidewalls 28. Further, partition wall 30 forms second opening 34 together with base 22, rear wall 26, and sidewalls 28. In the current embodiment, first opening 32 includes an area smaller than the second opening 34. However, a person skilled in the art understands that the area of first opening 32 and/or second opening 34 can be adjusted by changing the position or placement of partition wall 30 to form compartments in container 20.

Further, apparatus 12 includes sleeve 40. Sleeve 40 provides a material made of paper, flute (cardboard), plastic, wooden, metal, or any other suitable material. Sleeve 40 presents top portion 42, bottom portion 44, and sidewalls 46. Top portion 42, bottom portion 44, and sidewalls 46 form interior or hollow portion 48. Sleeve 40 provides front end 50 and rear end 52. In the current embodiment, front end 50 has a concave or curved configuration. Rear-end 52 has a flat or straight configuration and is perpendicular to sidewalls 46.

Figure 3:
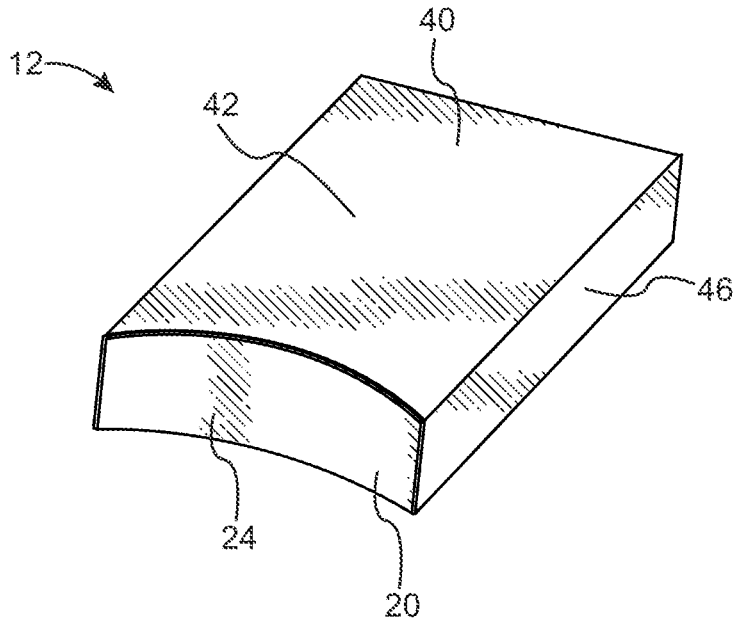

In the current embodiment, sleeve 40 has a diameter slightly larger than container 20. As such, container 20 draws/slides through and fits within sleeve 40, as shown in FIG. 3. Specifically, front wall 24 of container 20 draws through interior 48 via rear end 52. Container 20 slides through until front wall 24 reaches front end 50.

Figure 4:
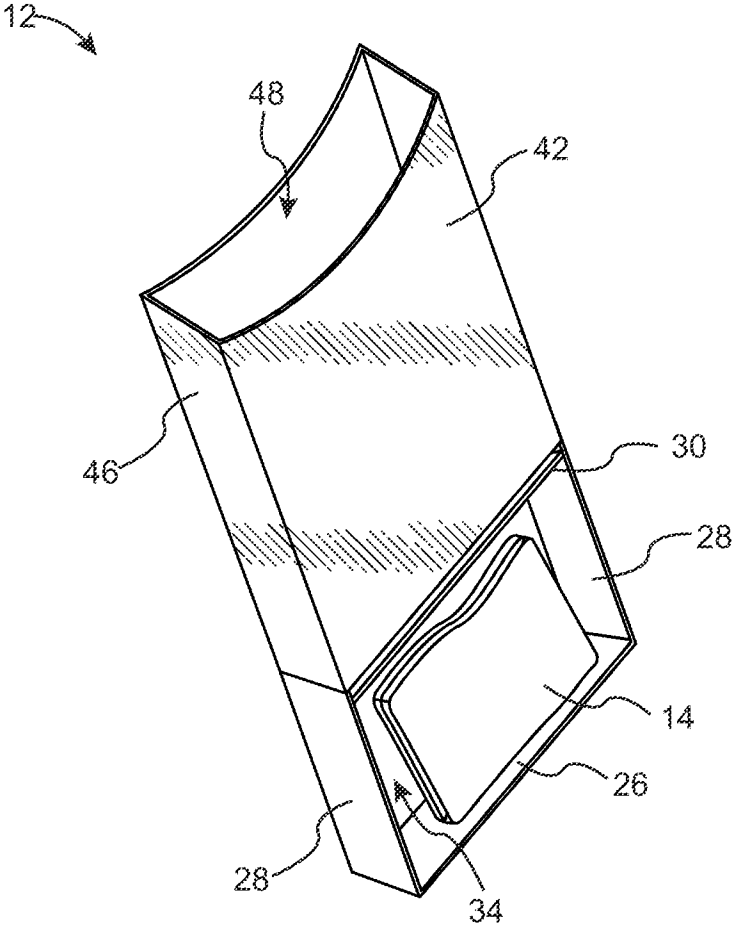

In accordance with one embodiment, container 20 stores food product 14 and an article (not shown). Food product 14 includes, but not limited to, a bakery product, bread, sandwich, bagel, cake, biscuit, etc. The article may include, but not limited to, a napkin, wiping cloth, hand towel, tissue paper, wipes, or any other product. In one example, container 20 receives the article in first opening 32 and food product 14 in second opening 34. FIG. 4 shows the feature of second opening 34 containing food product 14, for example.

Figure 5:
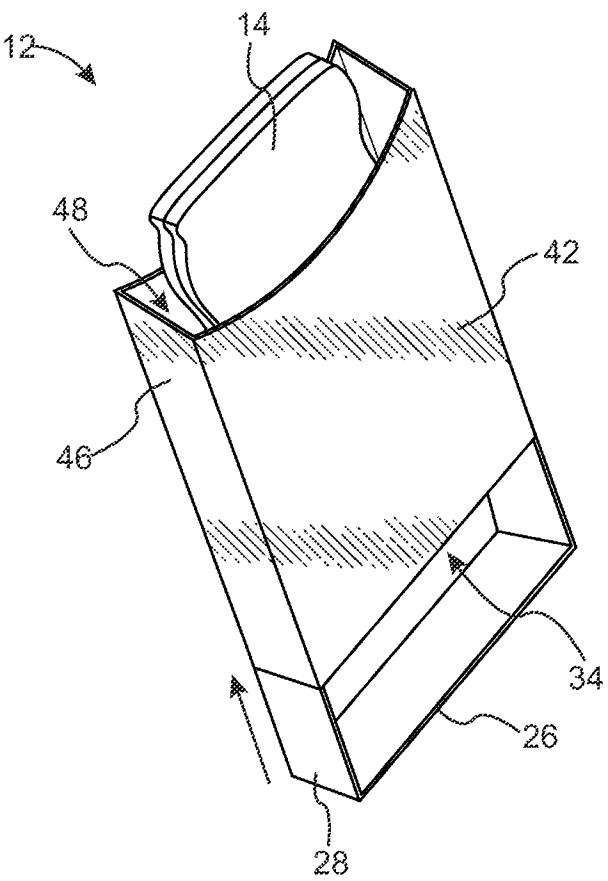
FIGS. 4 and 5 show the features of storing a food product in a container and holding a food product while being consumed, respectively.

In order to consume food product 14, user 16 slides or pulls container 20 from sleeve 30 to access food product 14 (FIG. 4). Subsequently, user 16 removes food product 14 from second opening 34 and places in interior 48 with support from front wall 24, as shown in FIG. 5. User 16 pushes or slides container 20 through sleeve 40 from second end 52 to first end 50 as he/she consumes food product 14. This helps user 16 to hold food product 14 using apparatus 12 without directly contacting food product 14. Further, contents of food product 14 (including excess food particles and/or residual items) fall outside of apparatus 12 or on front wall 24 through interior 48. As user 16 slides container 20 through sleeve 40 from second end 52 to first end 50 (FIGS. 3 and 5), excess food particles and/or residual items come out of interior 48 and fall out of apparatus 12. This ensures the hands of user 16 remain clean while consuming food product 14. Further, user 16 uses the article (tissue paper) placed in first opening 32 to wipe clean his/her hands of any food particles and/or residual items that he/she might have contacted while consuming food product 14.

Figure 6:
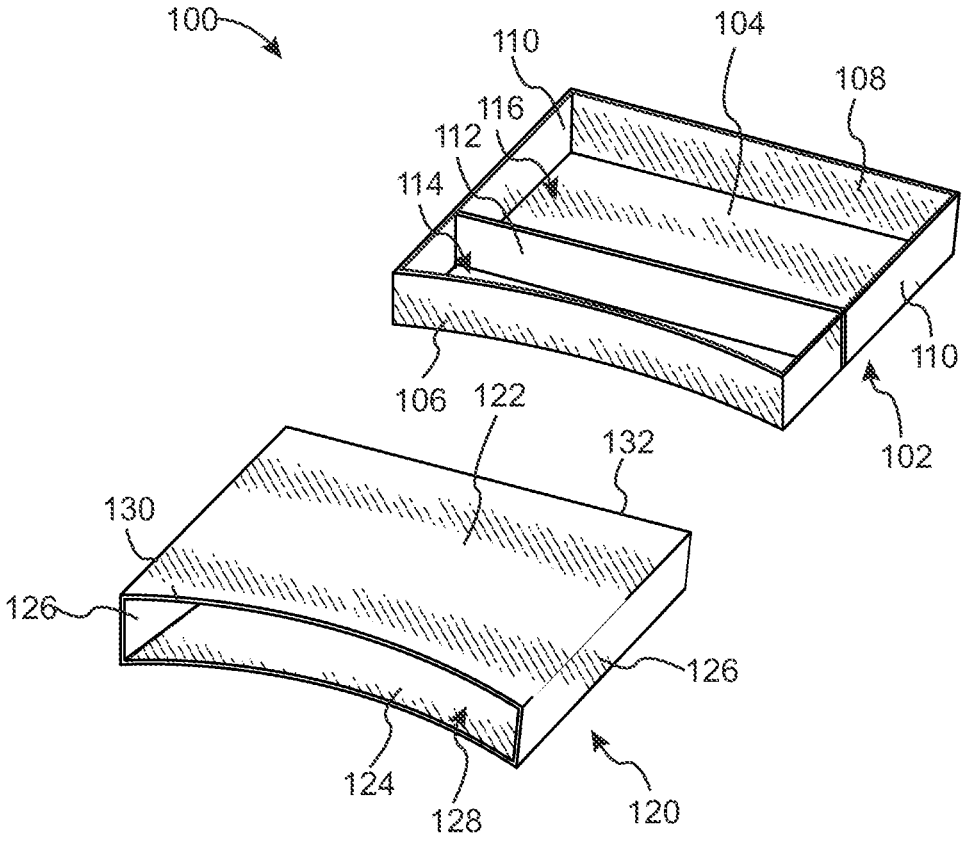
FIGS. 6 and 7 show an exploded view and a perspective view of an apparatus, respectively, in accordance with another embodiment of the present invention.

FIG. 6 shows an exploded view of apparatus 100 for storing, and holding a food product while being consumed, in accordance with one embodiment of the present invention. Apparatus 100 includes container 102 having base 104, front wall 106, rear wall 108, and sidewalls 110. Front wall 106, rear wall 108, and sidewalls 110 have suitable height and provide depth with base 104. In the current embodiment, front wall 106 has a concave or curved configuration. Rear wall 108 has a flat or straight configuration and is perpendicular to sidewalls 110. In the current embodiment, each of front wall 106 and rear wall 108 has more length than sidewalls 110.

Container 102 encompasses partition wall 112. Partition wall 112 mounts parallelly to rear wall 108. Partition wall 112 forms first opening 114 together with base 104, front wall 106, and sidewalls 110. Further, partition wall 112 forms a second opening 116 together with base 104, rear wall 108, and sidewalls 110. In the current embodiment, first opening 114 has an area smaller than the second opening 116. However, a person skilled in the art understands that the area of first opening 114 and/or second opening 116 can be adjusted by changing the position or placement of partition wall 112 in container 102.

Further, apparatus 100 includes sleeve 120. Sleeve 120 presents top portion 122, bottom portion 124 and sidewalls 126. Top portion 122, bottom portion 124 and sidewalls 126 form an interior or hollow portion 128. Sleeve 120 provides front end 130 and rear end 132. In the current embodiment, front end 130 has a concave or curved configuration. Rear end 132 has a flat or straight configuration and is perpendicular to sidewalls 126.

Figure 7:
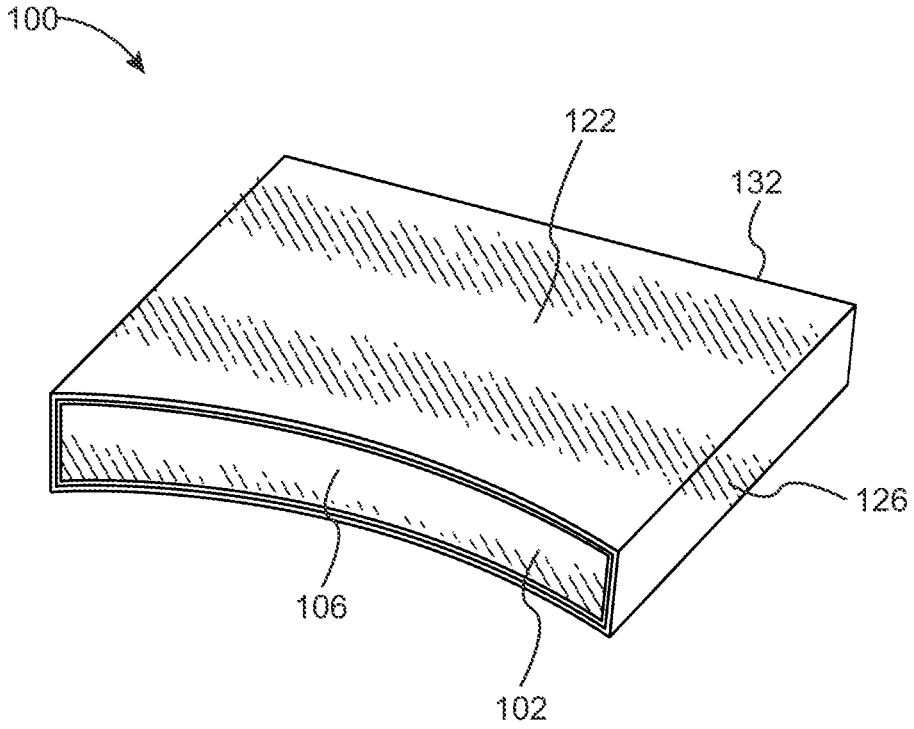

In the current embodiment, sleeve 120 has a diameter slightly larger than container 102. As such, container 102 draws/slides through and fits within sleeve 120, as shown in FIG. 7. In accordance with one embodiment, container 102 stores a food product 140 and an article (not shown). Food product 140 includes, but not limited to, a bakery product, bread, bagel, cake, biscuit, etc. The article may include, but not limited to, a napkin, wiping cloth, hand towel, or any other product. In one example, container 102 receives the article in first opening 114 and food product 140 in second opening 116.

Figure 8:
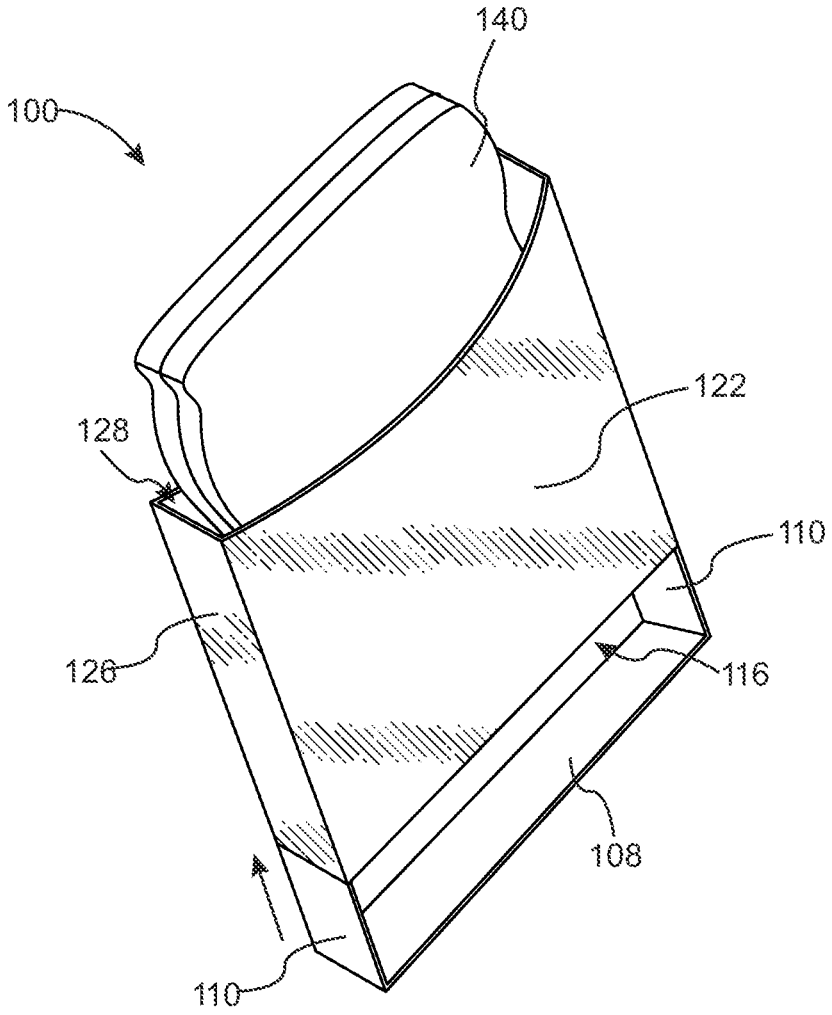
FIG. 8 shows the feature holding a food product with the apparatus.

In order to consume food product 140, a user slides or pulls container 102 from sleeve 120 to access food product 140. Subsequently, the user removes food product 140 from second opening 116 and places food product 140 in interior 128 with support from front wall 106, as shown in FIG. 8. The user then pushes or slides container 102 through sleeve 120 from second end 132 to first end 130 as he/she consumes food product 140, as explained above.

Figure 9:
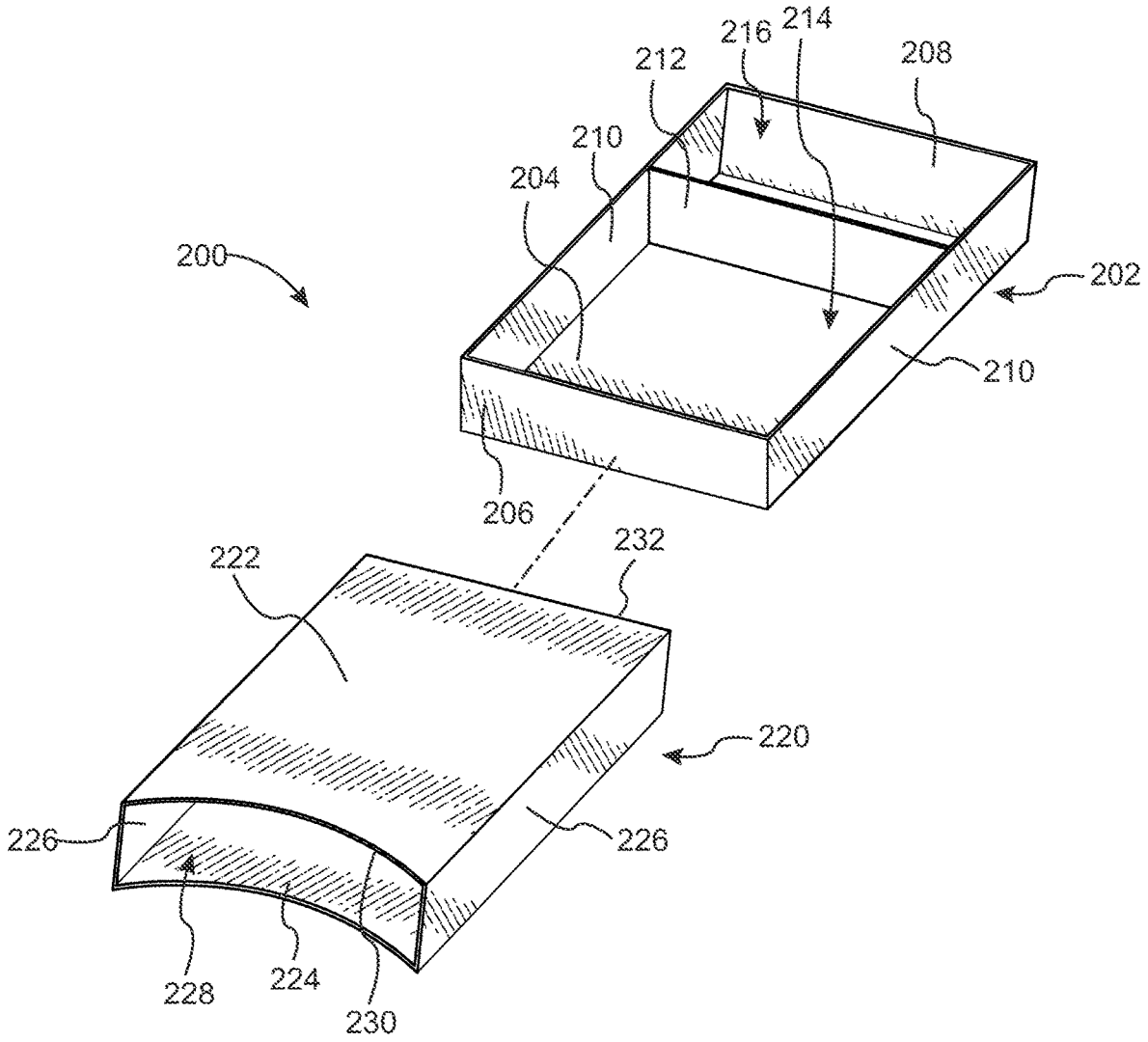
FIGS. 9 and 10 show an exploded view and a perspective view of an apparatus, respectively, in accordance with another embodiment of the present invention.

FIG. 9 shows an exploded view of an apparatus 200 for storing a food product, in accordance with another embodiment of the present invention. Apparatus 200 includes container 202 having base 204, front wall 206, rear wall 208, and sidewalls 210. Front wall 206, rear wall 208, and sidewalls 210 have suitable height and provide depth with base 204. In the current embodiment, each of front wall 206 and rear wall 208 have a flat or straight configuration and is perpendicular to sidewalls 210. In the current embodiment, sidewalls 210 have length greater than front wall 206 and rear wall 208 thereby providing container 202 in a rectangular configuration. However, a person skilled in the art appreciates that sidewalls 210 may have length equal to or less than front wall 206 and rear wall 208.

Container 202 encompasses partition wall 212. Partition wall 212 mounts parallelly to front wall 206 and rear wall 208. Partition wall 212 forms first opening 214 together with base 204, front wall 206, and sidewalls 210. Further, partition wall 212 forms a second opening 216 together with base 204, rear wall 208, and sidewalls 210. In the current embodiment, first opening 214 includes an area larger than second opening 216. However, a person skilled in the art understands that the area of first opening 214 and/or second opening 216 can be adjusted by changing the position or placement of partition wall 212 in container 202.

Figure 10:
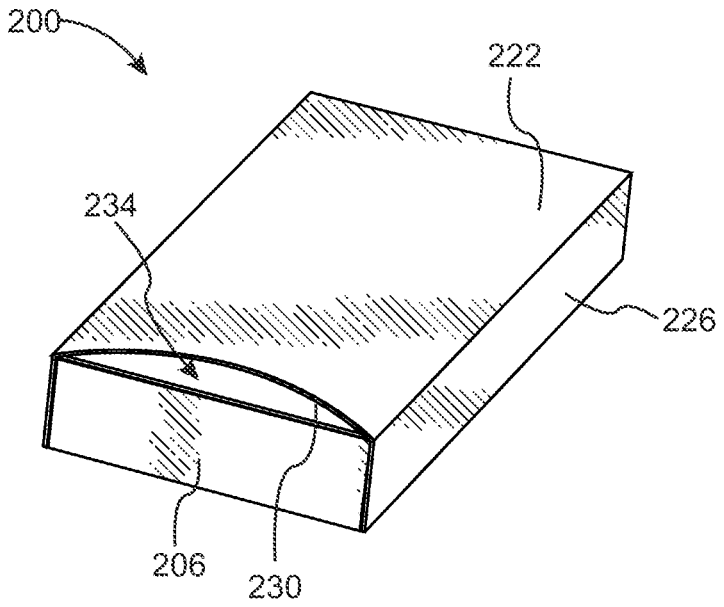

Further, apparatus 200 includes sleeve 220. Sleeve 220 presents top portion 222, bottom portion 224, and sidewalls 226. Top portion 222, bottom portion 224, and sidewalls 226 form an interior or hollow portion 228. Sleeve 220 provides front end 230 and rear end 232. In the current embodiment, front end 230 has a concave or curved configuration. Rear-end 232 has a flat or straight configuration and is perpendicular to sidewalls 226. In the current embodiment, sleeve 220 has a diameter slightly larger than container 202. As such, container 202 draws/slides through and fits within sleeve 220, as shown in FIG. 10. The difference in shapes of front wall 206 (flat configuration) and front end 208 (concave or curved configuration) create gap 234. Gap 234 allows a user to pull out container 202 from sleeve 220. Apparatus 200 operates similar to apparatus 12 or apparatus 100 as explained above.

Figure 11:
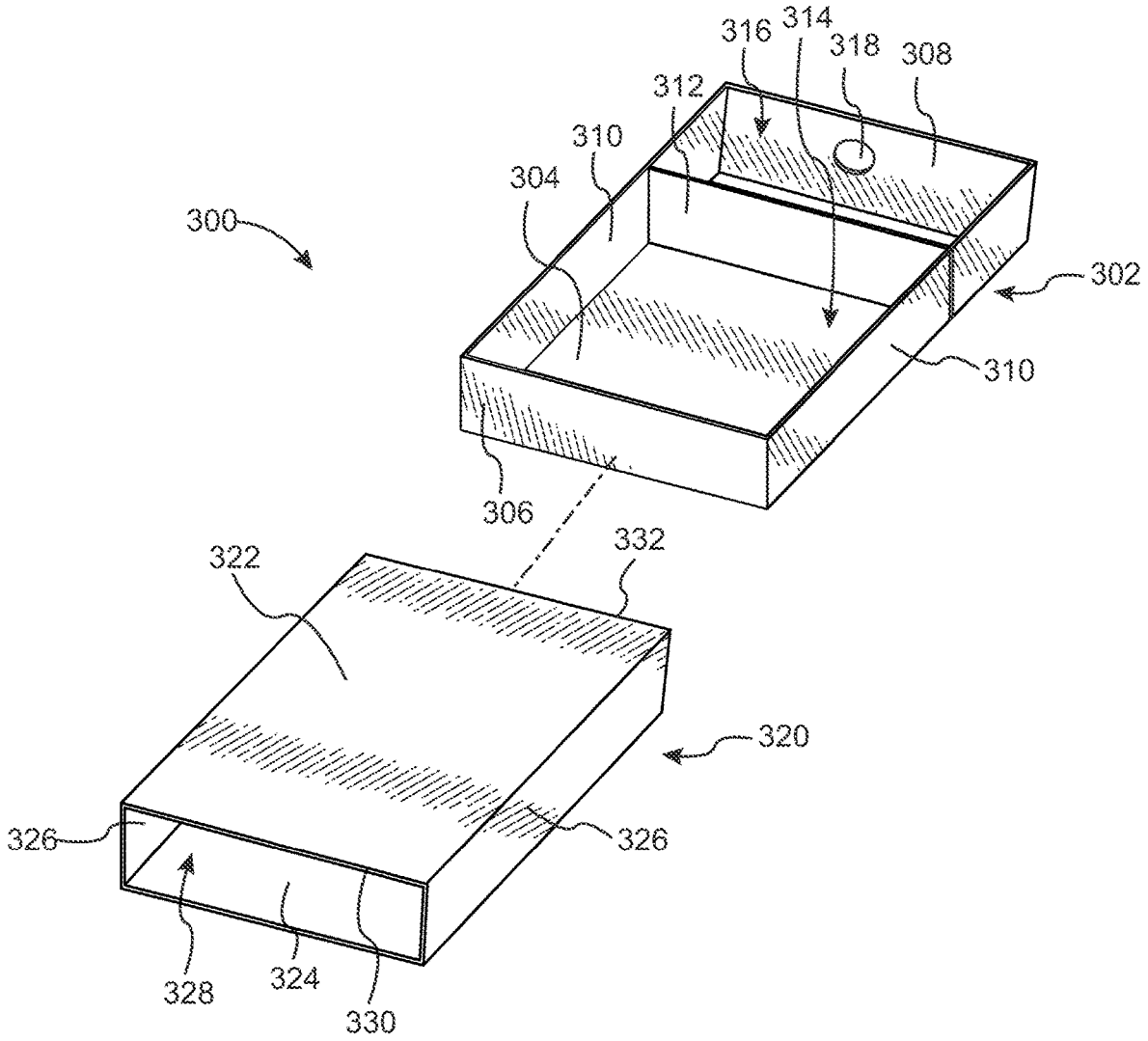
FIGS. 11 and 12 show an exploded view and a perspective view of an apparatus, respectively, in accordance with yet another embodiment of the present invention.

FIG. 11 shows an exploded view of an apparatus 300 for storing a food product, in accordance with another embodiment of the present invention. Apparatus 300 includes container 302 having base 304, front wall 306, rear wall 308, and sidewalls 310. Front wall 306, rear wall 308, and sidewalls 310 have suitable height and provide depth with base 304. In the current embodiment, each of front wall 306 and rear wall 308 have a flat or straight configuration and is perpendicular to sidewalls 310. In the current embodiment, sidewalls 310 have a length greater than front wall 306 and rear wall 308 thereby providing container 302 in a rectangular configuration. However, a person skilled in the art appreciates that sidewalls 310 may have a length equal to or less than front wall 306 and rear wall 308.

Container 202 encompasses partition wall 312. Partition wall 312 mounts parallelly to front wall 306 and rear wall 308. Partition wall 312 forms first opening 314 together with base 304, front wall 306, and sidewalls 310. Further, partition wall 312 forms second opening 316 together with base 304, rear wall 308, and sidewalls 310. In the current embodiment, first opening 314 includes an area larger than second opening 316. However, a person skilled in the art understands that the area of first opening 314 and/or second opening 316 can be adjusted by changing the position or placement of partition wall 312 in container 302.

In the current embodiment, rear wall 208 encompasses a cut-section 318. Cut-section 318 indicates a groove or hole provided on rear wall 208 to allow the user to use his/her finger to pull or push container 302 into sleeve 320. In one example, cut-section 318 comes in a variety of shapes including, but not limited to, a circular, square, rectangular, cylindrical or any other shape. Further, a person skilled in the art appreciates that cut-section 318 can be positioned at centre, corner or off-centre allowing the user to easily pull or push container 302 into sleeve 320.

Figure 12:
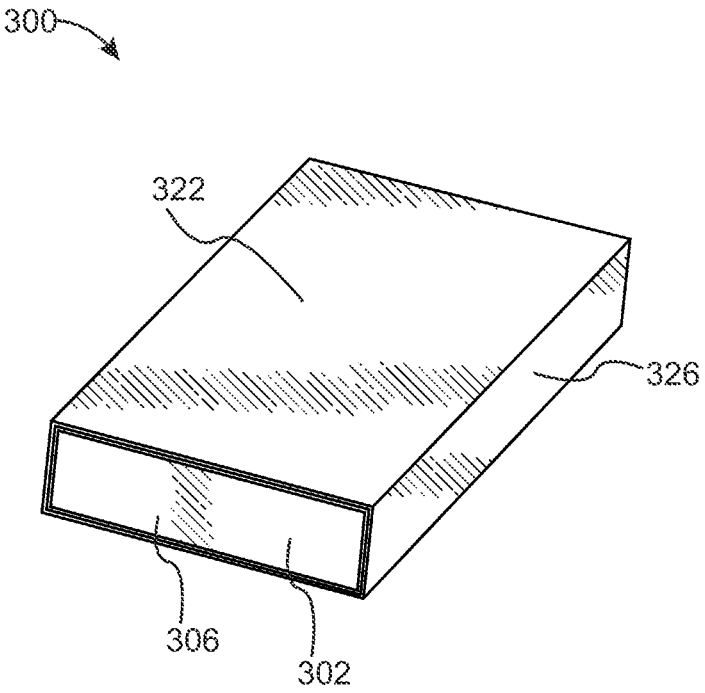

Apparatus 300 includes sleeve 320. Sleeve 320 presents top portion 322, bottom portion 324, and sidewalls 326. Top portion 322, bottom portion 324, and sidewalls 326 form an interior or hollow portion 328. Sleeve 320 provides front end 330 and rear end 332. In the current embodiment, each of front end 330 and rear end 232 has a flat or straight configuration and is perpendicular to sidewalls 326. In the current embodiment, sleeve 320 has a diameter slightly larger than container 302. As such, container 302 draws/slides through and fits within sleeve 320, as shown in FIG. 12. Apparatus 300 operates similar to apparatus 12 or apparatus 100 as explained above.

Although the above embodiments have been explained considering that the container includes a single partition wall that separates the container into two parts having the same or different sizes, the person skilled in the art understands that use of more than one partition wall allows for separating the container into multiple parts having same or varied sizes for storing multiple food products/items without deviating from the scope of the present invention.

Based on the above, it is evident that the apparatus allows storing food product(s) and article(s). When needed, the user removes the food product from the container and places the food product in the sleeve with support from the front wall of the container. The user pushes the container through the sleeve as he/she consumes the food product. This helps the user to hold the food product without directly contacting the food product. Further, this ensures that contents of the food product (including excess food particles and/or residual items) fall outside of the apparatus thereby ensuring the hands of the user remains clean while consuming the food product.

Figure 13A:
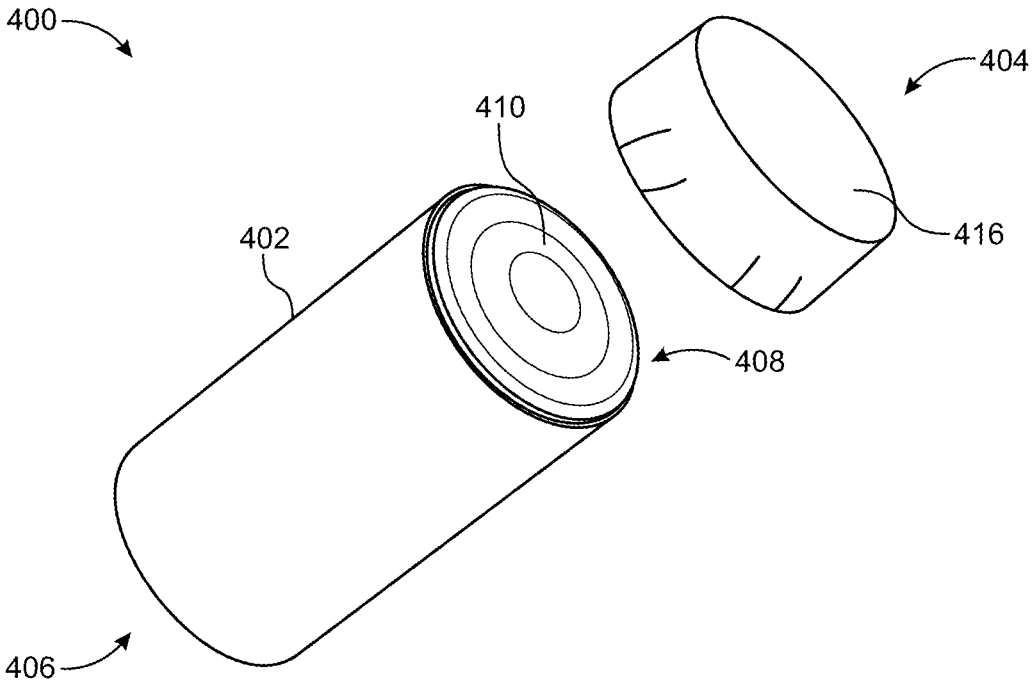
FIGS. 13A and 13B show exploded views of an apparatus, in accordance with yet another embodiment of the present invention.
Figure 13B:
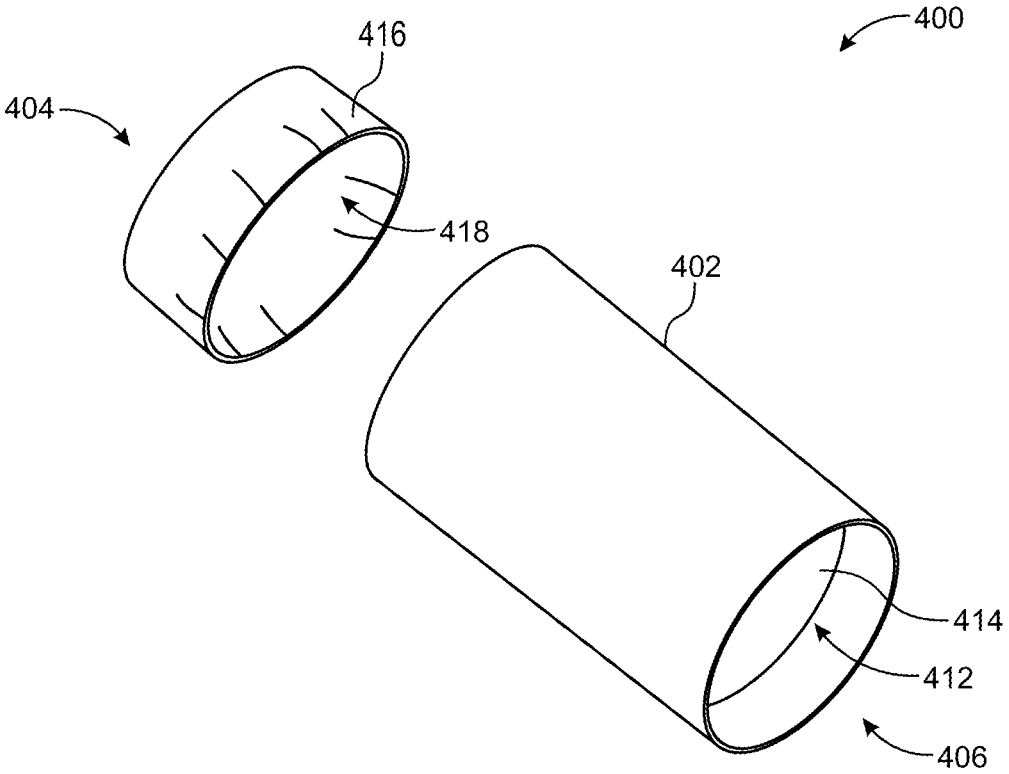
Figure 14:
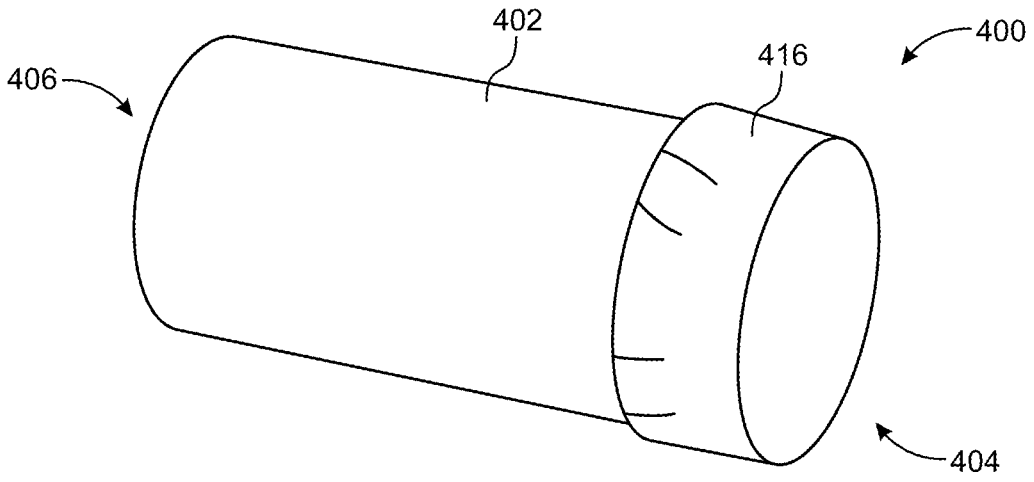
FIG. 14 shows a side perspective view of the apparatus in a closed configuration, in accordance with one embodiment of the present invention.

FIGS. 13A and 13B show exploded views of an apparatus 400, in accordance with another embodiment of the present invention. Apparatus 400 includes container 402. Container 402 comes in a cylindrical structure. Container 402 provides a material made of metal, plastic, wood, paper or any other suitable material. Container 402 presents first end 404 and second end 406. First end 404 indicates a front end and second end 406 indicates a rear end of container 402. At first end 404, container 402 encompasses an interior 408 for receiving food product 410 such as ice cream, candy or any other food item. At second end 406, container 402 encompasses opening 412. Further, container 402 includes wall 414 at second end 406. Wall 414 acts as a terminal barrier holding food product 410. Wall 414 is slidable along the interior walls of container 402. Wall 414 slides and pushes out food product 410 stored in interior 408.

Figure 15:
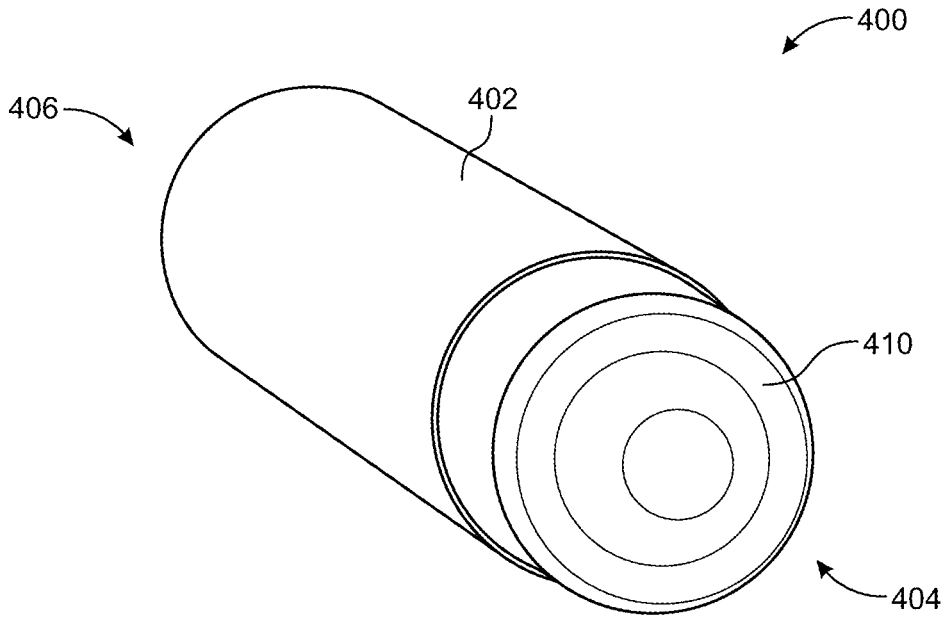
FIG. 15 shows operational view of the apparatus, in accordance with one embodiment of the present invention.

Container 402 includes cover or lid or cap or sleeve 416. In one example, cover 416 comes in a cylindrical configuration. Cover 416 has a slightly larger diameter than container 402. Cover 416 has cover opening 418 that fits over container 402 at first end 404 and prevents food product 410 from getting exposed. FIG. 15 shows the feature of cover 416 snugly fit over container 402 and protecting food product 410. Cover 416 helps to wrap food product 410 stored in container 402. When needed, a user (not shown) removes cover 416 and places his finger through opening 412 at second end 412. Here, the user pushes wall 414 towards first end 404 such that food product 410 comes out of interior 408 of container 402, as shown in FIG. 15. Once sufficient amount of food product 410 comes out of container 402, the user consumes food product 410.

The present embodiment is presented to explain sleeve receiving a portion of container as opposed to entire container in the embodiments explained using FIGS. 1 to 12. A person skilled in the art understands that both container and the sleeve can come in a variety of shapes, sizes and forms depending on the type of food product that needs to be stored and used for consumption and any obvious modifications to either of the container or sleeve fall within the scope of the present invention.

In one implementation, the apparatus may come in a variety of colours to provide visual appeal to the user for using the apparatus as a lunch box in schools, colleges, offices, factories, etc.

Applicants or inventors of the present invention intend to market the apparatus as "sandwich gripper", "sandwich grip" "breadbox", "sandwich box" or any other suitable names.

A person skilled in the art appreciates that the apparatus may come in a variety of shapes and sizes depending on the need and comfort of the user. Further, many changes in the design and placement of components may take place without deviating from the scope of the presently disclosed apparatus.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. An apparatus, comprising:

a container having a base, and a front wall, a rear wall and first sidewalls, wherein said first sidewalls extend from said base, wherein said base, said front wall, said rear wall and said sidewalls form an opening, and wherein said front wall and said rear wall are flat; and a sleeve configured to receive said container, wherein said sleeve comprises a top portion, a bottom portion, and second sidewalls, wherein said second sidewalls connect said top portion and said bottom portion, wherein said top portion, said bottom portion, and said second sidewalls form a hollow structure for receiving said container, wherein a front end of each of said top portion, and said bottom portion of said sleeve is curved for creating a gap between said sleeve and said container at said front wall with the opening for allowing a user to pull out said container from said sleeve, wherein said rear wall comprises a cut-section for allowing said user to pull or push said container into said sleeve, wherein said container receives a food product at said opening and slides into said sleeve enclosing said food product, wherein said container slides partially away from said sleeve and said food product positions at said front wall of said container such that said food product is surrounded by said top portion, said bottom portion, and said second sidewalls of said sleeve, and wherein said container slides progressively into said sleeve pushing said food product for consumption by said user.

2. The apparatus of claim 1, wherein said container comprises at least one partition wall extending from said base parallel to said front wall and said rear wall for partitioning said container.

3. The apparatus of claim 1, wherein said container comes in a square or rectangular configuration.

4. The apparatus of claim 1, wherein said container is made from one of metal, plastic, wood, and paper material.

5. The apparatus of claim 1, wherein said sleeve is made from one of metal, plastic, wood, and paper material.

6. A method of providing an apparatus for holding a food product and allowing for consumption of said food product, said method comprising the steps of:

providing a container having a base, and a front wall, a rear wall and first sidewalls, said first sidewalls extending from said base, and said base, said front wall, said rear wall and said first sidewalls forming an opening, said front wall and said rear wall being flat;

providing a sleeve for receiving said container, said sleeve comprising a top portion, a bottom portion, and second sidewalls, and said second sidewalls connecting said top portion and said bottom portion, said top portion, said bottom portion, and said second sidewalls forming a hollow structure for receiving said container;

providing a front end of each of said top portion, and said bottom portion of said sleeve in a curved configuration for creating a gap between said sleeve and said container at said front wall with the opening for allowing a user to pull out said container from said sleeve;

providing a cut-section at said rear wall for allowing said user to pull or push said container into said sleeve;

receiving a food product into said container;

sliding said container into said sleeve for enclosing said food product;

sliding said container partially away from said sleeve such that said food product positions at said front wall of said container surrounded by said top portion, said bottom portion, and said second sidewalls of said sleeve; and sliding progressively said container into said sleeve for pushing said food product for consumption by said user.

7. The method of claim 6, further comprising providing at least one partition wall extending from said base parallel to said front wall and said rear wall for partitioning said container.

* * * * *